US005259450A

United States Patent [19]

Fischer

[11] Patent Number: 5,259,450

[45] Date of Patent: Nov. 9, 1993

[54] VENTED PACKER FOR SAMPLING WELL

[75] Inventor: David Fischer, Ann Arbor, Mich.

[73] Assignee: QED Environmental Systems, Inc., Ann Arbor, Mich.

[21] Appl. No.: 946,898

[22] Filed: Sep. 17, 1992

[51] Int. Cl.[5] ..... E21B 34/00

[52] U.S. Cl. ..... 166/68; 166/106

[58] Field of Search ..... 166/67, 68, 5, 105, 166/106

[56] References Cited

U.S. PATENT DOCUMENTS 4,257,751 3/1981 Kofahl .
4,354,554 10/1982 Calhoun et al. ..... 166/106 X
4,489,779 12/1984 Dickinson et al. .
4,585,060 4/1986 Bernardin et al. .
4,632,184 12/1986 Renfroe, Jr. et al. ..... 166/106 X
4,727,936 3/1988 Mioduszewski et al. .
5,190,108 3/1993 Mansuy ..... 166/68 X

*Primary Examiner*—Thuy M. Bui
*Attorney, Agent, or Firm*—Harness, Dickey & Pierce

[57] ABSTRACT

There is provided an apparatus for obtaining liquid samples from a well which incorporates a vented packer. The packer reduces the amount of groundwater which must be pumped by the pump of the apparatus in order to purge the well by isolating the input of the pump to a reduced volume of groundwater. The region below the packer, which is the region in communication with the pump, is vented to the atmosphere in order to permit the pump to operate at its maximum pumping rate regardless of the recovery rate of the well. The venting of the packer eliminates the condition where the pump is trying to pull a vacuum due to a low recovery rate of the well.

12 Claims, 2 Drawing Sheets

VENTED PACKER FOR SAMPLING WELL

FIELD OF THE INVENTION

The present invention relates to an apparatus for obtaining liquid samples from a well or the like. More particularly, the present invention relates to an apparatus for obtaining liquid samples which minimizes the amount of liquid which must be purged prior to obtaining an acceptable sample from both a high and low recovery well.

BACKGROUND AND SUMMARY OF THE INVENTION

Recent increases in public concern for the environment have resulted in various government imposed environmental regulations. Among such regulations are requirements relating to the monitoring of groundwater quality. In response to these requirements, water quality analytic capabilities have been improved and water sampling equipment has been developed. Much of the previously developed sampling equipment has not been effective, however, in obtaining consistent, non-contaminated water samples that are accurately representative of the water system from which the sample is taken.

The inadequacies of the previous sampling equipment stem largely from such causes as cross-contamination between sampling sites, ineffective and inconsistent field cleaning methods, contamination due to equipment handling, and inconsistent well depth sampling. In addition to presenting sample quality problems, much of the previous equipment has been heavy and bulky and thus difficult to transport from one monitoring site to another. Finally, much of such previous equipment has proved to be complicated to operate, inordinately expensive, and impractical for sampling at remote locations where site access is severely limited.

Prior to obtaining an acceptable water sample, the well must sometimes be purged between 3 and 5 times. Depending on the size of the well and the static level of water in the well, the amount of time this purging procedure takes can be excessive. Packers have been developed which are located between the static level of the water in the well and the pump to isolate the area below the packer to reduce the amount of water which must be pumped in order to purge the well. On a high recovery well equipped with a pump and a packer, this system performs acceptably. When a pump and a packer are used in conjunction with a low recovery well, it is not possible to purge the well any quicker than the recovery rate of the well. It is not possible to form a vacuum in the volume below a packer with a standard bladder pump. Thus, in low recovery wells, the amount of time which is required to obtain an acceptable water sample is unacceptable.

In accordance with the present invention, a fluid sampling apparatus is provided for use in obtaining accurate samples of groundwater or other fluids from both high and low recovery wells. In the preferred embodiment, the pump is dedicated to a particular monitoring well or other sampling site in order to substantially avoid cross-contamination of samples from site to site and is constructed from light weight non-contaminating materials. A vented packer is provided for the fluid sample apparatus which minimizes the amount of liquid which must be purged prior to obtaining an acceptable sample. The venting of the packer enables a low recovery well to be purged at the volume rating of the pump similar to a high recovery well.

A fluid sampling pump for use in conjunction with the present invention, to which a vented packer is added to reduce the amount of liquid which must be purged prior to sampling, is disclosed in U.S. Pat. No. 4,489,779 issued Dec. 25, 1984 to Dickinson et al. and U.S. Pat. No. 4,585,060 issued Apr. 29, 1986 to Bernardin et al., the disclosures and drawings of which are hereby expressly incorporated by reference. A fluid sampling pump which has an integral packer is shown in U.S. application Ser. No. 941,693, entitled "Sampling Pump with Packer" and naming K. Lynn Niehaus as inventor. The above application is being filed concurrently herewith, the disclosure and drawings of which are hereby expressly incorporated by reference. Both applications are being assigned to the same assignee.

The preferred sampling pump is a submersible, fluid actuated pump wherein the actuating fluid is preferably a gas. A first flexible bladder member separates and isolates the interior of the pump into two chambers; a first chamber that contains the sample fluid and is in communication with both the pump inlet and outlet and a second chamber that surrounds the first chamber with the first bladder disposed therebetween. The second chamber is connected to a source of actuating gas.

A vented packer is disposed between the intake of the pump and the static level of the water in the well. The packer comprises a packer housing which has a second flexible bladder member which forms a third chamber that surrounds the packer housing. The third chamber is connected to a source of actuating gas. The conduits necessary for operating the pump below the packer pass through the packer housing and are sealed where they pass through the packer housing. The area below the packer is vented either to the area in the well casing above the static level of the water or to the atmosphere through the wellhead assembly. Prior to the pumping of groundwater, the third chamber on the packer is pressurized to expand the second bladder member. This separates the groundwater within the monitoring well into two regions, with the region below the packer being in communication with the first chamber of the pump.

The sample liquid is conveyed through the pump by alternately pressurizing and venting or relieving the pressure in the second chamber to contract and relax the first bladder member thus alternately decreasing and increasing the volume of the first chamber. Sample fluid is drawn into the first chamber from the area below the second bladder member during such increases in volume under the influence of the natural hydrostatic head of the groundwater and is discharged through the pump outlet during such decrease in volume, thereby conveying the sample fluid through the pump.

The second bladder member thus minimizes the amount of groundwater which must be purged prior to accepting a sample by isolating the intake of the first chamber of the pump from the total volume of fluid in the monitoring well or other sampling site. The venting of the area below the packer allows the pump to operate at its maximum capacity regardless of the recovery rate of the well. The components of the pump and packer are preferably composed of low cost, light weight synthetic materials that are non-corrosive and do not otherwise affect the chemical composition of the sampled fluid.

The sampling pump and packer are preferably dedicated to, and thus remain in, a particular sampling site or well without fluid pressure supplied to either the second or third chamber. The sampling site or well is substantially isolated form the above-ground surroundings by a wellhead assembly in order to reduce potential contamination during sampling. A portable controller apparatus is provided with quick-disconnect means and includes means for pressurizing the third chamber and means for alternately pressurizing and de-pressurizing the actuating fluid in the second chamber. The fluid sampling apparatus may also optionally include means for measuring the standing level of the fluid in the well.

Additional advantages and features of the present invention will become apparent from the following description and the appended claims taken in conjunction with the accompanying drawings.

DETAILED DESCRIPTION OF THE PREFERRED EMBODIMENT

Figure 1:
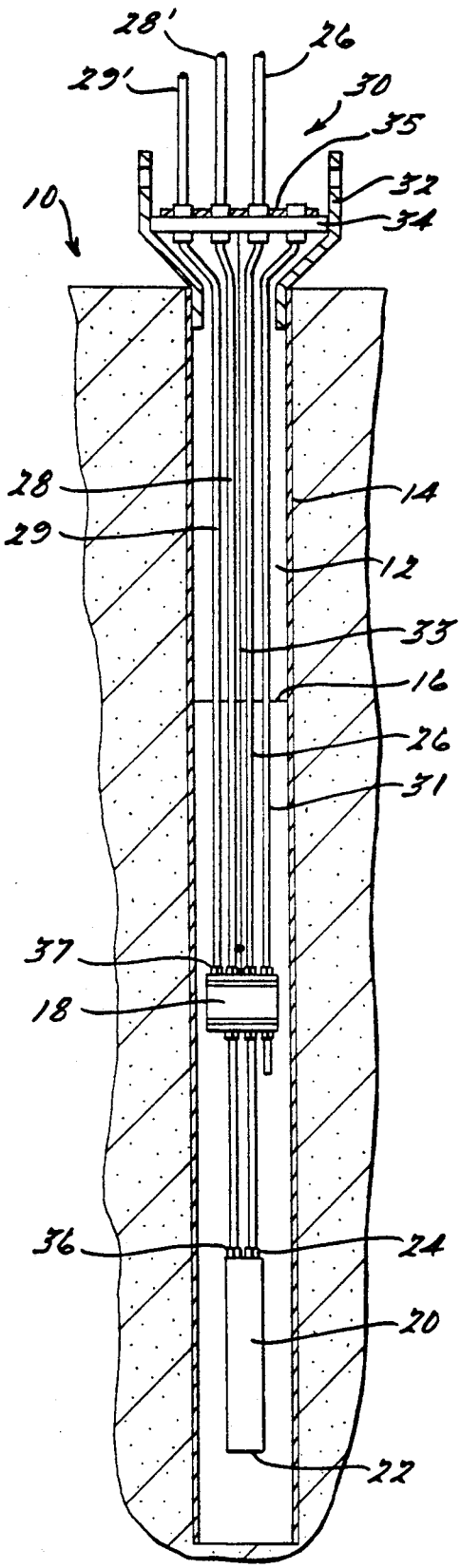
FIG. 1 is a longitudinal sectional view of a fluid sampling system in accordance with the present invention.

For purposes of illustration, FIGS. 1 through 4 of the drawings depict exemplary embodiments of a fluid sampling apparatus according to the present invention as installed in a monitoring well for withdrawing samples of groundwater. One skilled in the art will readily recognizes from the following discussions that the principles of the invention are equally applicable to fluid sampling apparatuses other than that shown in the drawings as well as to other fluid pumping apparatuses.

Figure 2:
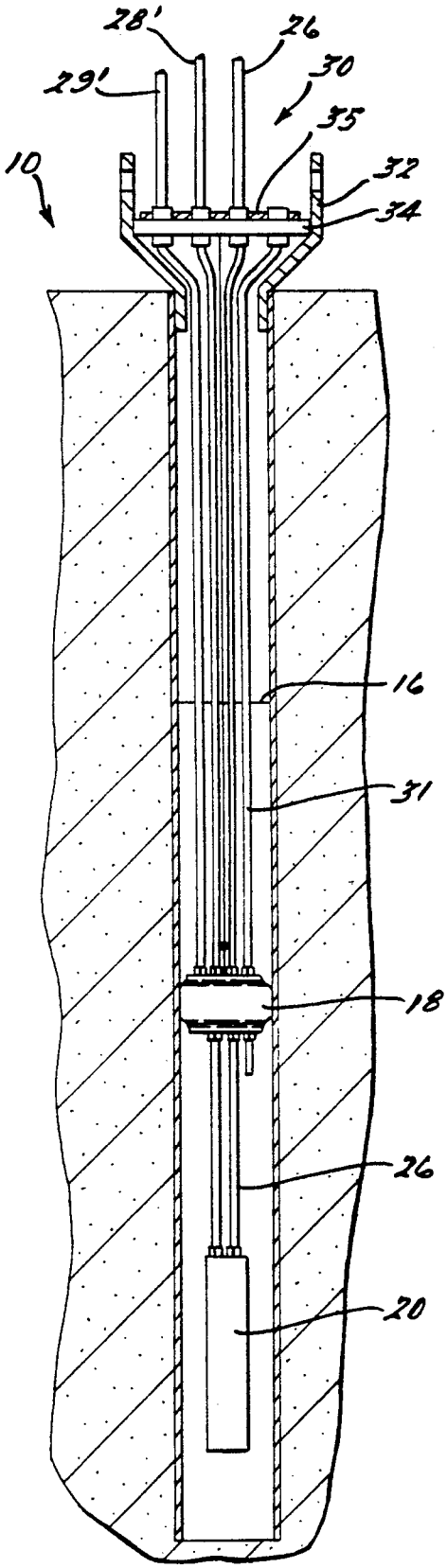
FIG. 2 is a longitudinal cross-sectional view of the fluid sampling system of FIG. 1 with the packer in the inflated state.

In FIGS. 1 and 2, an exemplary fluid sampling apparatus according to the present invention is indicated generally by reference numeral 10 and is shown for purposes of illustration as installed in a monitoring well 12, which preferably includes a well casing 14. A fluid sampling pump 20 is disposed within the well casing 14 of the monitoring well 12 and is submerged beneath the water level of the groundwater 16 to a suitable depth for obtaining accurate and representative groundwater samples. A packer 18 is disposed in the well 12 between the static level of the water 16 and pump 20.

The preferred fluid sampling pump 20 is a fluid-actuated bladder pump, wherein the actuating fluid is preferably a gas such as air, for example, and includes an inlet port 22 and an outlet port 24. A wellhead assembly 30 is secured to the well casing 14 and includes a wellhead body portion 32 having a generally horizontal support plate 34 therein. The body portion 32 substantially isolates the interior of the well 12 from the above ground surrounding environment in order to avoid or at least minimize contamination of the interior of the well which would result from contact between the groundwater 16 and the air or other elements. The wellhead assembly 30 also includes a groundwater conduit 26 sealingly connected at one end to the pump outlet 24, sealingly passing through packer 18 and then passing through plate 34 to provide direct sample delivery to a sample collection vessel (not shown). A pumping gas conduit 28 is connected at one end to a pumping gas connection 36 on pump 20, then passes through packer 18 and then is connected at the other end to support plate 34. An inflation gas conduit 29 is connected at one end to an inflation gas connection 37 on packer 18 and at the other end to the support plate 34. A venting conduit 31 is open at one end to the area below packer 18 and sealingly passes through packer 18 and is connected to support plate 34 for venting the region below the packer 18 to the outside atmosphere. While the embodiment shown connects the upper end of the venting conduit 31 to the support plate 34, it is to be understood that the venting line could end anywhere within the casing 14 above the static level 16 of the groundwater in the well. Because the pump 20 and the packer 18 are preferably of a lightweight construction, the conduits 26, 28, 29 and 31 may also be used to help retain the pump 20 and the packer 18 in their submerged position in the well 12. Since the vented packer must support the full weight of the groundwater above the packer, a support cable 33 may be provided. Support cable 33 would support packer 18 through attachment to a support plate 35.

A controller apparatus, which is described in further detail in the disclosures of U.S. Pat. Nos. 4,489,779 and 4,585,060 as well as below, is selectively and removably connected to the wellhead assembly 30 by means of external gas conduits 28' and 29'. The preferred controller apparatus is a portable, lightweight unit and includes a source of actuating gas and means for positively pressurizing the packer 18 and means for alternately positively pressurizing and venting or relieving the pressure of the actuating gas to operate the fluid sampling pump 20.

In order to further isolate the interior of the well 12 from above ground contamination, the wellhead assembly 30 preferably includes a closure member adapted to be secured to the body portion 32 by a locking pin insertable through corresponding aligned apertures in the body portion 32 and in the closure member. The locking pin preferably includes an aperture at one end, through which a padlock or other suitable locking means may be inserted in order to substantially prevent unauthorized access to the interior portions of the wellhead assembly. The system is described in further detail in the disclosures of U.S. Pat. Nos. 4,489,779 and 4,585,060.

Figure 3:
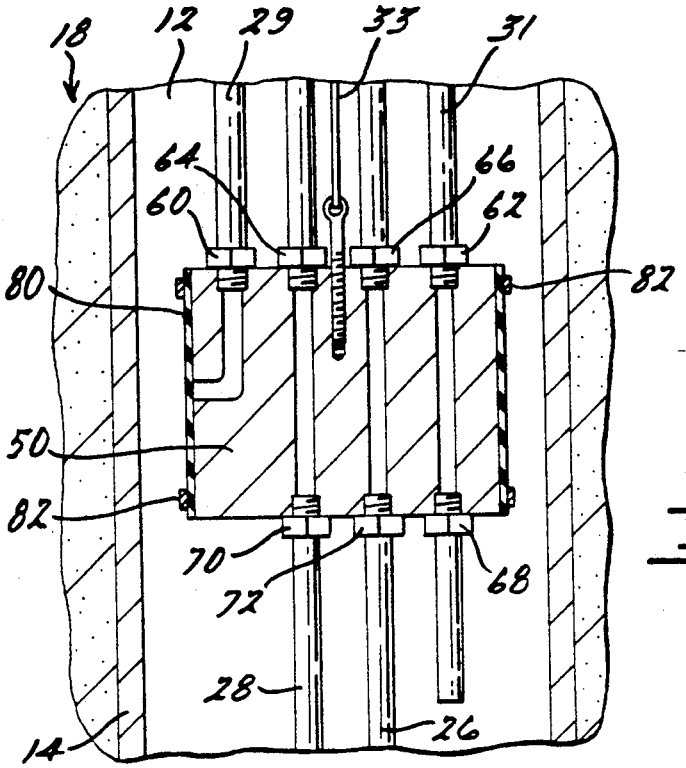
FIG. 3 is an enlarged longitudinal cross-sectional view of the packer shown in FIG. 1.
Figure 4:
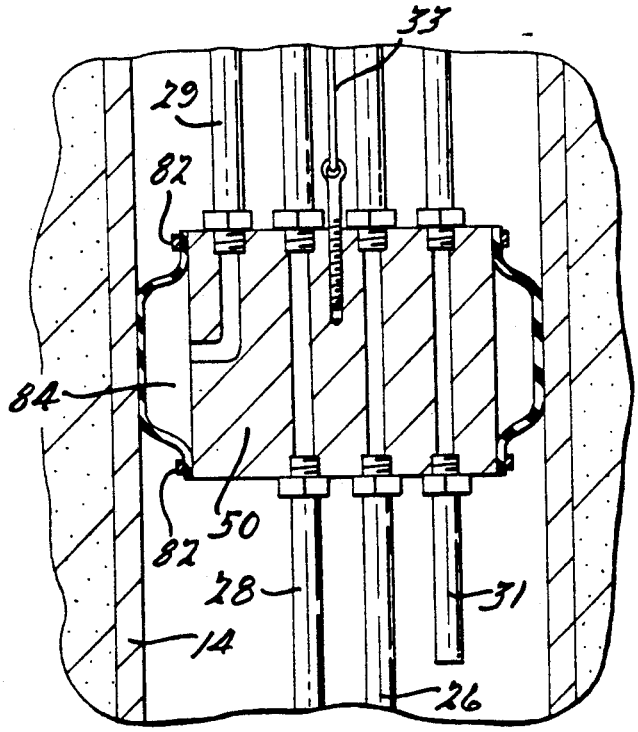
FIG. 4 is an enlarged longitudinal cross-sectional view of the packer shown in FIG. 2.

Referring to FIGS. 3 and 4, the packer 18 includes a generally cylindrical housing 50 having on its upper side an inflation port 60, a venting inlet port 62, a pumping inlet port 64, support cable 33 and a groundwater outlet port 66. The lower side of housing 50 has a venting outlet port 68, a pumping outlet port 70, and a groundwater inlet port 72.

The exterior of housing 50 has a generally cylindrical flexible bladder 80 sealingly connected to housing 50 at its opposite ends by means of rings 82 which are swaged or otherwise deformed to sealingly force the bladder material against the exterior surface of housing 50. The rings 82 may be composed of a soft ductile material or other readily deformable materials known to those skilled in the art. The bladder 80 defines an annular gas chamber 84 between the bladder interior and exterior wall surface of housing 50.

Referring to FIGS. 1 through 4, the fluid sampling apparatus 10 is activated by means of an actuating gas supplied to gas chamber 84 through conduit 29. This actuating gas causes bladder 80 to expand and make sealing contact with the interior wall of well casing 14. The expansion of bladder 80 divides the groundwater present in well casing 14 into an upper and lower region with the lower region being vented to the outside atmosphere. In order for the well to be purged, the fluid sampling pump 20 only needs to pump the water contained in the lower region beneath bladder 80, thus significantly reducing the amount of groundwater which must be pumped prior to acceptance of a groundwater sample. The venting of the area below the packer 18 by vent conduit 31 permits the fluid sampling pump 20 to operate at its maximum output without attempting to draw a vacuum while purging a low recovery well.

It should be noted that except for the swaged rings 82, the various components of the pump 20 and packer 18 are preferably composed of relatively lightweight and low cost synthetic materials that will not corrode when exposed to the groundwater 16 and will not otherwise affect the composition of the groundwater flowing through the pump 20. Examples of such materials include rigid polyvinyl chloride (PVC) or virgin grade tetrafluoroethylne (TFE) teflon. The flexible bladders are preferably composed of a flexible synthetic material which also will not corrode or affect the composition of groundwater flowing therethrough such as flexible polyvinyl chloride, Buna-N rubber, or VITON, for example. VITON is a trademark owned by E. I. DuPont de Nemours & Company for its fluoro-elastomer materials. One skilled in the art will readily recognize, however, that the various components of the fluid sampling apparatus may be composed of other suitable non-corrosive materials.

The preferred controller apparatus generally includes the external gas conduits 28' and 29', means for supplying an actuating gas to gas chamber 84 of the packer, means for supply an actuating gas to the pump 20 and means for alternately pressurizing and venting, or relieving, the pressure of the actuating gas to the pump 20 as described above in order to actuate the fluid sampling pump. The various physical components of the preferred controller apparatus are well known to those skilled in the art and thus are described only schematically in the disclosure of U.S. Pat. Nos. 4,489,779 and 4,585,060 in terms of their functions with the exception of the supply of actuation gas to the packer. A person skilled in the art can easily connect the actuating gas source to the external supply line 29' and provide a simple on/off switch for expanding and contracting bladders 84.

When using an integral packer as described in U.S. application Ser. No. 07/941,693, now U.S. Pat. No. 5,238,060 entitled "Fluid Sampling Pump with Packer" naming K. Lynn Niehaus and David Fischer as inventors, the venting of the packer is similar to that described above for the separate packer. When venting the integral packer, the pump must be kept hydraulically submerged in order to pump the groundwater as the bladder pumps described above have no suction capability.

The foregoing discussion discloses and describes merely exemplary embodiments of the present invention. One skilled in the art will readily recognize from such discussion that various changes, modifications and variations may be made therein without departing from the spirit and scope of the invention as defined in the following claims.

What is claimed is:

1. A groundwater sampling apparatus for withdrawing groundwater samples from a groundwater monitoring well, said apparatus having dedicatable inground components to prevent the apparatus from contaminating another well, said apparatus comprising:

a pump adapted to be submerged in the groundwater within said well, said pump being permanently dedicatable to said well and having a groundwater chamber with an inlet and an outlet; said groundwater chamber of said pump being in communication with said portion of said groundwater in said well through said inlet when said pump is submerged in said groundwater;

a packer separating said groundwater within said well into an upper and lower region, said lower region below said packer being vented to the atmosphere such that air from the atmosphere is allowed to replace said groundwater being pumped from said lower region of said well;

a wellhead assembly permanently dedicatable to said well and adapted to be secured to said well to isolate the interior of said well from the above-ground surroundings, said wellhead assembly further including first conduit means communicable with said pump and said wellhead assembly, and second conduit means communicable with said packer and said wellhead assembly.

2. The groundwater sampling apparatus of claim 1 wherein said packer comprises:

a flexible bladder sealingly attached to said pump, said flexible bladder defining a gas chamber between said pump and said flexible bladder.

3. The groundwater sampling apparatus of claim 1 wherein said packer comprises:

a packer housing disposed within said well between said pump and said wellhead assembly;

a flexible bladder sealingly attached to said packer housing, said flexible bladder defining a gas chamber between said packer housing and said flexible bladder.

4. A groundwater sampling apparatus for withdrawing groundwater samples from a groundwater monitoring well, said apparatus having dedicatable inground components to prevent the apparatus from contaminating another well, said apparatus including a gas-actuated water sampling pump having a first gas chamber for receiving a gas therein, a gas-actuated packer having a second gas chamber for receiving gas therein, said packer separating said groundwater within said well into an upper and lower region, said lower region below said packer being vented to the atmosphere such that air from the atmosphere is allowed to replace said groundwater being pumped from said lower region of said well, and a controller selectively communicable with said sampling pump and said packer, said controller including:

a source of said gas under pressure;

first valve means connected to said source of said gas and being actuable into a pressurizing mode to provide gas communication between said source of said gas and said first gas chamber of said sampling pump and actuable into a relief mode to provide gas communication between said gas chamber and a region having a pressure lower than that of said source;

second valve means connected to said source of gas and being actuable into a pressurizing mode to provide gas communication between said source of said gas and said second gas chamber of said packer; and pneumatic timing control means for selectively actuating said first valve means into a pressurizing mode for a first predetermined time period and actuating said first valve means into a relief mode for a second predetermined time period, thereby causing the pressure of said gas in said first gas chamber to be alternately raised and lowered;

said controller systems being portable so as to be selectively connectable to and disconnectable from said sampling pump in said monitoring well or to a correlative dedicated inground sampling pump in similar monitoring wells.

5. The groundwater sampling apparatus of claim 4 wherein said packer comprises:

a flexible bladder sealingly attached to said pump, said flexible bladder defining a gas chamber between said pump and said flexible bladder.

6. The groundwater sampling apparatus of claim 4 wherein said packer comprises:

a packer housing disposed within said well;

a flexible bladder sealingly attached to said packer housing, said flexible bladder defining said second gas chamber between said packer housing and said flexible bladder.

7. A groundwater sampling apparatus for withdrawing groundwater samples from a groundwater monitoring well, said apparatus having dedicatable inground components to prevent the apparatus from contaminating other monitoring wells, said apparatus having a gas-actuated water sampling pump for said groundwater monitoring well, said water sampling pump having a first gas chamber for receiving a gas therein, a gas-actuated packer associated with said pump, said packer having a second gas chamber for receiving gas therein, said packer separating said groundwater within said well into an upper and lower region, said lower region below said packer being vented to the atmosphere such that air from the atmosphere is allowed to replace said groundwater being pumped from said lower region of said well and a controller system for controlling pressurization of gas in said first and second gas chambers, said water sampling pump being substantially installed in, and dedicated to, said groundwater monitoring well, said controller system being portable and being selectively connectable to, and disconnectable from said water sampling pump or to correlative dedicated inground sampling pumps in similar groundwater monitoring wells, said controller system including:

a source of said gas under pressure;

means for communicating said source of said gas to said first and second gas chambers, and means for selectively operating said last mentioned means to cause the pressure of said gas in said first chamber to be alternately raised and lowered.

8. The groundwater sampling apparatus of claim 7 wherein said packer comprises:

a flexible bladder sealingly attached to said pump, said flexible bladder defining said second gas chamber between said pump and said flexible bladder.

9. The groundwater sampling apparatus of claim 7 wherein said packer comprises:

a packer housing disposed within said well;

a flexible bladder sealingly attached to said packer housing, said flexible bladder defining said second gas chamber between said packer housing and said flexible bladder.

10. A groundwater sampling apparatus for withdrawing groundwater samples from a groundwater monitoring well, said apparatus having dedicatable inground components to prevent the apparatus from contaminating similar groundwater monitoring wells, comprising:

a gas-actuated pump adapted to be submerged in the groundwater within said well for pumping a portion of said groundwater therefrom, said pump being substantially permanently installable in, and dedicatable to, said well and having a pump body portion including a first gas chamber, a groundwater chamber having an inlet and an outlet, and a flexible bladder for isolating said first gas chamber from said groundwater chamber, said groundwater chamber being in communication with said groundwater in said well through said inlet when said pump is submerged therein, substantial portions of said pump, including said pump body portion and said flexible bladder being composed of a polymeric material;

a wellhead assembly substantially permanently installable on, and dedicatable to said well and including a wellhead body portion adapted to be secured to said well to isolate the interior of said well from the above-ground surroundings, said wellhead assembly further including a first gas conduit having one end sealingly connected to said first gas chamber and an opposite end fixedly and sealingly connected to said wellhead body portion, a second gas conduit having one end sealingly connected to said second gas chamber and an opposite end fixedly and sealingly connected to said wellhead body portion, a groundwater conduit having one end sealingly connected to said outlet of said groundwater chamber and substantially uninterruptedly passing through said wellhead assembly to an opposite end in communication with the above-ground surroundings for collecting a sample quantity of said groundwater from said well;

a packer separating said groundwater within said well into an upper and lower region, said lower region below said packer being vented to the atmosphere such that air from the atmosphere is allowed to replace said groundwater being pumped from said lower region of said well;

controller apparatus including means selectively connectable to, and disconnectable from, said wellhead assembly in fluid communication with said first and second gas conduits for supplying an actuating gas to said first and second gas chambers, said first gas chamber of said pump having the pressure of said actuating gas in said first gas chamber alternately pressurized and relieved in order to cause said bladder to alternately contract and relax to actuate said pump.

11. The groundwater sampling apparatus of claim 10 wherein said packer comprises:

a flexible bladder sealingly attached to said pump, said flexible bladder defining said second gas chamber between said pump and said flexible bladder.

12. The groundwater sampling apparatus of claim 10 wherein said packer comprises:

a packer housing disposed within said well between said pump and said wellhead assembly;

a flexible bladder sealingly attached to said packer housing, said flexible bladder defining a gas chamber between said packer housing and said flexible bladder.

* * * * *